US008567660B2

(12) United States Patent
Sullivan et al.

(10) Patent No.: US 8,567,660 B2
(45) Date of Patent: Oct. 29, 2013

(54) SUSTAINABLE PACKAGING SYSTEM FOR SHIPPING LIQUID OR VISCOUS PRODUCTS

(75) Inventors: Joseph Sullivan, Plymouth, MA (US); Bob Buchenen, Sandwich, MA (US); Steve Gosling, Brampton (CA)

(73) Assignee: CDF Corporation, Plymouth, MA (US)

( * ) Notice: Subject to any disclaimer, the term of this patent is extended or adjusted under 35 U.S.C. 154(b) by 580 days.

(21) Appl. No.: 12/620,446

(22) Filed: Nov. 17, 2009

(65) Prior Publication Data

US 2011/0114713 A1 May 19, 2011

(51) Int. Cl.
*B65D 5/56* (2006.01)
*B65B 3/02* (2006.01)

(52) U.S. Cl.
USPC ..... 229/117.3; 229/125.05; 53/452

(58) Field of Classification Search
USPC ..... 229/117.3, 164.2; 220/23.91, 495.03
See application file for complete search history.

(56) References Cited

U.S. PATENT DOCUMENTS

| | | | |
|---|---|---|---|
| 875,780 | A | 1/1908 | Coats |
| 931,808 | A | 8/1909 | Smith |
| 1,120,058 | A | 12/1914 | Hutto |
| 1,132,000 | A | 3/1915 | Dight |
| 1,135,866 | A | 4/1915 | Turner |
| 1,975,198 | A | 10/1934 | Doleman |
| 2,083,776 | A | 6/1937 | Ferguson |
| 2,155,057 | A | 4/1939 | Moore |
| 2,260,064 | A | 10/1941 | Stokes |
| 2,333,587 | A | 11/1943 | Salfisberg |
| 2,339,156 | A | 1/1944 | Davis |
| 2,339,665 | A | 1/1944 | Alman |
| 2,352,503 | A | 6/1944 | Walton |
| 2,446,308 | A | 8/1948 | Smith |
| 2,533,554 | A | 12/1950 | Byerly |
| 2,638,263 | A | 5/1953 | Jesnig |
| 2,720,998 | A | 10/1955 | Potter |

(Continued)

FOREIGN PATENT DOCUMENTS

| | | |
|---|---|---|
| CA | 1 159 379 | 12/1983 |
| CA | 2 156 796 | 2/1997 |

(Continued)

OTHER PUBLICATIONS

Advertisement, "Designed with Food in Mind, the Unifold Food Grade Intermediate Bulk Container," LB Systemer a/s Uni-Fold, Nordgarde 1A-4520 Svinninge Denmark, 5 pgs. Date unknown.

(Continued)

*Primary Examiner* — Gary Elkins
*Assistant Examiner* — Christopher Demeree
(74) *Attorney, Agent, or Firm* — Dorsey & Whitney LLP

(57) ABSTRACT

The present disclosure, in one embodiment, relates to a packaging assembly for holding liquids, viscous material, or particulate material. The packaging assembly includes a carton having side and bottom walls and an open top. A self-supporting plastic liner fits inside of the carton, and is for containing liquids, viscous material, or particulate material. The liner has a side wall, a closed bottom end, and an open top end having an outwardly-projecting rim. The rim has a radially-extending flange portion, and a dependent skirt portion. When the self-supporting plastic liner is inside of the carton, the dependent skirt portion of the rim hangs over the side walls of the carton. A lidding material is removeably affixed to the rim of the plastic liner. A carton lid closes off the open top of the carton.

23 Claims, 7 Drawing Sheets

(56) References Cited

U.S. PATENT DOCUMENTS 2,738,796 A 3/1956 Chadwick
2,757,669 A 8/1956 Gewecke et al.
2,799,314 A 7/1957 Dreyer et al.
2,902,202 A 9/1959 Fallert
2,930,423 A 3/1960 Cunningham
2,950,037 A 8/1960 Orsini
2,951,628 A 9/1960 Grussen
2,956,839 A 10/1960 Hermanns
2,973,119 A 2/1961 Parker
3,006,257 A 10/1961 Orsini
3,039,656 A 6/1962 Wentz
3,044,515 A 7/1962 Eades
3,087,491 A 4/1963 Gewecke et al.
3,119,548 A 1/1964 Cook et al.
3,143,277 A 8/1964 LaFleur
3,208,658 A 9/1965 Membrino
3,224,640 A 12/1965 Schneider
3,244,576 A 4/1966 Swartz
3,253,764 A 5/1966 Goetschius
3,275,197 A 9/1966 Eklund
3,289,386 A 12/1966 Farmer
3,319,684 A 5/1967 Calhoun
3,349,991 A 10/1967 Kessler
3,367,380 A 2/1968 Dickey
3,370,774 A 2/1968 Hopf
3,384,106 A 5/1968 Isbrandtsen
3,386,645 A 6/1968 Powell
3,415,440 A 12/1968 Watters
3,434,652 A 3/1969 Shore
3,447,732 A 6/1969 Jonas
3,462,067 A 8/1969 Shore
3,510,142 A 5/1970 Erke
3,550,662 A 12/1970 Remke et al.
3,559,847 A 2/1971 Goodrich
3,709,426 A 1/1973 Farkas
3,739,977 A 6/1973 Shapiro et al.
3,761,013 A 9/1973 Schuster
3,836,217 A 9/1974 Shiina
3,853,238 A 12/1974 Luisada et al.
3,868,891 A 3/1975 Parish
3,890,762 A 6/1975 Ernst et al.
3,951,284 A 4/1976 Fell et al.
3,965,953 A 6/1976 Becker et al.
3,989,157 A 11/1976 Veenema
3,995,806 A 12/1976 McSherry
4,011,798 A 3/1977 Bambara et al.
4,025,048 A 5/1977 Tibbitts
4,056,913 A * 11/1977 Bamburg et al. ..... 53/449
4,085,244 A 4/1978 Stillman
4,094,460 A 6/1978 Scanga et al.
4,169,548 A 10/1979 Bond
4,174,051 A 11/1979 Edwards et al.
4,177,907 A 12/1979 Funaioli et al.
4,184,527 A 1/1980 Kawamura
4,239,111 A 12/1980 Conant et al.
4,267,960 A 5/1981 Lind et al.
4,270,533 A 6/1981 Andreas
4,305,535 A 12/1981 Brundige et al.
4,309,466 A 1/1982 Stillman
4,362,199 A 12/1982 Futerman
4,421,253 A 12/1983 Croley
4,444,355 A 4/1984 Cary
4,448,345 A 5/1984 Helms
4,449,646 A 5/1984 Bonerb et al.
4,457,456 A 7/1984 Derby et al.
4,461,402 A 7/1984 Fell et al.
4,466,553 A * 8/1984 Zenger ..... 220/495.08
4,476,998 A 10/1984 Bonerb et al.
4,482,074 A 11/1984 Lalley
4,518,097 A 5/1985 Milton et al.
4,524,459 A 6/1985 Titchenal
4,548,321 A 10/1985 Mockesch et al.
4,560,090 A 12/1985 Okushita
4,561,107 A 12/1985 Herder
4,596,040 A 6/1986 LaFleur et al.
4,597,102 A 6/1986 Nattrass
RE32,232 E 8/1986 Bonerb et al.
4,636,190 A 1/1987 Herder
4,673,112 A 6/1987 Bonerb
4,674,127 A 6/1987 Yamada et al.
4,676,373 A 6/1987 Schneider
4,715,508 A 12/1987 Schurch
4,718,577 A 1/1988 Morris et al.
4,730,942 A 3/1988 Fulcher
4,781,472 A 11/1988 LaFleur et al.
4,783,178 A 11/1988 Herder
4,790,029 A 12/1988 LaFleur et al.
4,796,788 A 1/1989 Bond
4,804,113 A 2/1989 Ciaccio
4,850,506 A 7/1989 Heaps et al.
4,874,258 A 10/1989 Marino
4,898,301 A 2/1990 Schick
4,917,255 A 4/1990 Foy
4,923,077 A 5/1990 Van Iperen et al.
4,931,034 A 6/1990 Wagner
4,941,754 A 7/1990 Murdock
4,997,108 A 3/1991 Hata
4,998,990 A 3/1991 Richter et al.
5,002,194 A 3/1991 Nichols
5,020,922 A 6/1991 Schirmer
5,025,982 A 6/1991 Lisiecki
5,029,734 A 7/1991 Nichols
5,037,002 A 8/1991 Tschanen
5,040,693 A 8/1991 Podd et al.
5,054,644 A 10/1991 Greenslade
5,056,667 A 10/1991 Coogan
5,074,460 A 12/1991 Hanekamp
5,096,092 A 3/1992 Devine
5,104,236 A 4/1992 LaFleur
5,120,586 A 6/1992 Nedzu et al.
5,127,893 A 7/1992 Lafleur
5,156,291 A 10/1992 Mielke
5,193,710 A 3/1993 Podd et al.
5,195,661 A 3/1993 Light
5,253,763 A 10/1993 Kirkley et al.
5,265,797 A 11/1993 Velge et al.
5,269,414 A 12/1993 D'Hollander
5,292,026 A 3/1994 Stolzman
5,302,402 A 4/1994 Dudenhoeffer et al.
5,314,086 A 5/1994 Short
5,314,250 A 5/1994 Lee
5,330,069 A 7/1994 Jamison et al.
5,335,820 A 8/1994 Christianson
5,338,117 A 8/1994 Kucksdorf et al.
5,341,952 A 8/1994 Goglio
5,344,048 A 9/1994 Bonerb
5,344,065 A 9/1994 Moran
5,350,239 A 9/1994 Strand et al.
5,368,395 A 11/1994 Crimmins
5,400,916 A 3/1995 Weber
5,427,306 A 6/1995 Petriekis et al.
5,487,470 A 1/1996 Pharo
5,489,037 A 2/1996 Stopper
5,492,270 A 2/1996 Avery et al.
5,494,394 A 2/1996 Podd et al.
5,499,743 A 3/1996 Blumenkron
5,531,361 A 7/1996 Podd
5,547,284 A 8/1996 Imer
5,549,944 A 8/1996 Abate
5,588,549 A 12/1996 Furtner
5,618,254 A 4/1997 Derby
5,636,764 A 6/1997 Bonerb
5,660,299 A 8/1997 Harvey
5,692,546 A 12/1997 Podd et al.
5,711,444 A 1/1998 Meacham et al.
5,765,723 A 6/1998 Wilcox
5,775,541 A 7/1998 Perkins
5,788,121 A 8/1998 Sasaki et al.
5,799,818 A 9/1998 Ringer
5,851,072 A 12/1998 LaFleur
5,865,541 A 2/1999 Lafleur
5,915,596 A 6/1999 Credle, Jr.
5,918,984 A 7/1999 LaFleur et al.
5,924,302 A 7/1999 Derifield

(56) References Cited

U.S. PATENT DOCUMENTS

| | | | |
|---|---|---|---|
| 5,941,421 | A | 8/1999 | Overman et al. |
| 5,984,850 | A | 11/1999 | Derby |
| 5,988,422 | A | 11/1999 | Vallot |
| 6,120,181 | A | 9/2000 | Wilcox |
| 6,139,482 | A | 10/2000 | Lafleur |
| 6,193,416 | B1 | 2/2001 | Kawamata et al. |
| 6,234,351 | B1 | 5/2001 | Wilcox |
| 6,325,281 | B1 | 12/2001 | Grogan |
| 6,332,711 | B1 | 12/2001 | Inuzuka et al. |
| 6,371,646 | B1 | 4/2002 | LaFleur |
| 6,374,579 | B1 | 4/2002 | Muller |
| 6,378,733 | B1 | 4/2002 | Boonzaier |
| 6,427,873 | B2 | 8/2002 | Wilcox |
| 6,443,617 | B2 | 9/2002 | Tetenborg |
| 6,467,652 | B2 | 10/2002 | Wilcox et al. |
| 6,527,445 | B2 | 3/2003 | LaFleur et al. |
| 6,533,122 | B1 | 3/2003 | Plunkett |
| 6,536,687 | B1 | 3/2003 | Navis et al. |
| 6,588,681 | B2 | 7/2003 | Rothrum et al. |
| 6,595,441 | B2 | 7/2003 | Navis et al. |
| 6,607,097 | B2 | 8/2003 | Savage et al. |
| 6,644,510 | B2 | 11/2003 | Kowalics et al. |
| 6,663,018 | B2 | 12/2003 | Rothrum et al. |
| 6,752,179 | B1 | 6/2004 | Schwartz |
| 6,868,982 | B2 | 3/2005 | Gordon |
| 6,883,683 | B1 | 4/2005 | Cunningham et al. |
| 6,892,933 | B2 | 5/2005 | Sullivan, Jr. |
| 6,910,582 | B2 | 6/2005 | Lantz |
| 7,077,309 | B2 | 7/2006 | Andrews |
| 7,244,064 | B2 | 7/2007 | Sullivan, Jr. |
| 7,334,702 | B2 | 2/2008 | Cunningham et al. |
| 2002/0071922 | A1 | 6/2002 | Bailey |
| 2002/0148857 | A1 | 10/2002 | Savage et al. |
| 2002/0164089 | A1 | 11/2002 | LaFleur et al. |
| 2003/0235349 | A1 | 12/2003 | Ricahrdson, Jr. et al. |
| 2004/0118741 | A1 | 6/2004 | Sullivan, Jr. |
| 2005/0017011 | A1 | 1/2005 | Andrews |
| 2005/0078890 | A1 | 4/2005 | Abe et al. |
| 2005/0100252 | A1 | 5/2005 | Rivlin et al. |
| 2005/0220369 | A1 | 10/2005 | Sullivan, Jr. |
| 2005/0220639 | A1 | 10/2005 | Sasaki et al. |
| 2006/0023973 | A1 | 2/2006 | Plunkett et al. |
| 2007/0076988 | A1 | 4/2007 | Sullivan et al. |
| 2007/0201774 | A1 | 8/2007 | Plunkett et al. |

FOREIGN PATENT DOCUMENTS

| | | |
|---|---|---|
| DE | 60 598 | 11/1890 |
| DE | 1 486 433 | 4/1969 |
| DE | 89 06 059.8 | 11/1989 |
| EP | 0 098 322 | 1/1984 |
| EP | 0 362 102 | 4/1990 |
| EP | 0 276 994 | 12/1992 |
| EP | 1 277 666 | 1/2003 |
| EP | 1 435 265 | 7/2004 |
| EP | 1 415 719 | 5/2009 |
| FR | 1 331 060 | 5/1963 |
| FR | 2 316 151 | 3/1977 |
| FR | 2 375 113 | 8/1978 |
| FR | 2 742 129 | 6/1997 |
| GB | 1 591 323 | 6/1981 |
| GB | 2 194 512 | 3/1988 |
| GB | 2 245 883 | 1/1992 |
| GB | 2 268 231 | 1/1994 |
| GB | 2 323 846 | 10/1998 |
| GB | 2 356 854 | 6/2001 |
| JP | 64-009174 | 1/1989 |
| JP | 2-139383 | 5/1990 |
| JP | 5-221451 | 8/1993 |
| JP | 6-115557 | 4/1994 |
| JP | 6-122457 | 5/1994 |
| JP | 6-179455 | 6/1994 |
| JP | 6-255657 | 9/1994 |
| JP | 8-104391 | 4/1996 |
| WO | 82/03838 | 11/1982 |
| WO | 89/11422 | 11/1989 |
| WO | 98/32539 | 7/1998 |
| WO | 02/057151 | 7/2002 |
| WO | 02/064456 | 8/2002 |
| WO | 02/074226 | 9/2002 |
| WO | 2007/038438 | 4/2007 |

OTHER PUBLICATIONS

Advertisement, "Stocklin, Collapsible Container, innovative and Environment-Friendly Packaging," Walter Stocklin AG, Forder Und Lagertechnik, CH-4143 Dornach/Schweiz, 4 pgs. Date unknown.

Advertisement, "CFS Developments (Proprietary) Ltd.," Postal Address: P.O. Box 4852 Luipaardsvlei 1743 South Africa, 4 pgs. Date unknown.

Advertisement, "Reusable Container Systems, Industry Leader in quality, innovation and service," Ropak Corporation, Materials Handling Group, A Member of the Linpac Group of Companies, 7 pgs. Date unknown.

Advertisement, "ECONOBOX, A Whole New Dimension, Cost-effective Solutions for Materials Handling," GE Polymer Logistics, 3 pgs. Date unknown.

Advertisement, "Introducing the Arena 330 Shipper, It beats the drum and everything else," GE Silicones, A. R. Arena Products, Inc., 2101 Mt. Read Blvd., Rochester, New York, 1465, 4 pgs. Date unknown.

Advertisement, TNT Container Logistics, Containers for Hazardous Goods, Hazcon & Uni-Fold, 2 pgs. Date unknown.

Author unknown, "TNT: TNT Liquid Discharge Roller Arm," 2 pgs., date unknown.

* cited by examiner

SUSTAINABLE PACKAGING SYSTEM FOR SHIPPING LIQUID OR VISCOUS PRODUCTS

FIELD OF THE INVENTION

The present disclosure relates to packaging and more particularly to a sustainable packaging system including a carton and a sealed liner assembly for shipping liquid, viscous, or particulate products.

BACKGROUND OF THE INVENTION

Substantially rigid plastic containers with replaceable covers, e.g., bucket-type containers, are commonly used to package and ship selected liquid and viscous materials in the nature of foods and food preparation materials, cosmetic preparations, detergents, and the like. Such containers are sturdy, typically having a wall thickness in the range of about 0.075 inches to about 0.090 inches, and have a large mouth that renders them well suited for storing and dispensing a variety of viscous liquids, e.g., syrups, mustard, and cosmetic preparations. A typical 20 liter empty bucket may weigh approximately 2.25 lbs.

Another mode of shipping liquid products is the "bag & box" arrangement in which a bag, made of flexible single or double ply plastic film and provided with a fitment for discharge of the bag's contents, is stored in a box made of corrugated cardboard. The latter type of packaging system is well suited for free-flowing liquids such as vinegar, wine, detergents, and the like. However, it is not well suited for viscous materials for a number of reasons. For example, it is difficult to remove all of the contents from the bag, due to the inability to scrape out the residual contents from the bag. Additionally, in the case of a material that consists of several ingredients that tend to separate from one another on standing, it is not possible to introduce a stirring implement into the bag for the purpose of mixing the contents to obtain a homogenous material.

Further limitations stem from plastic recycling requirements and food packaging regulations. Environmental regulations require containers with a volume of 5 gallons or less to be made of a recyclable material. Additionally, governmental regulations require that plastic containers for foodstuffs be made of a virgin plastic material. The substantially rigid plastic containers comprise a relatively large amount of plastic in comparison to the flexible bags used in the "bag & box" packaging system, thereby increasing the amount of plastic that has to be disposed of or recycled. Making such containers of virgin plastic is costly and hence discourages their use for containing foodstuffs. The "bag & box" system employs less plastic, but the bags are not as sturdy as the substantially stiff containers and also cannot be used where it is essential to access all of the contents or where it is desired to mix the contents in situ.

BRIEF SUMMARY OF THE INVENTION

The present disclosure relates to a packaging system and more particularly to a sustainable packaging system including a carton and a sealed liner assembly for shipping liquid, viscous, or particulate products.

The present disclosure in one embodiment, relates to a packaging assembly for holding liquids, viscous material, or particulate material. The packaging assembly includes, a carton having side and bottom walls and an open top forming a top edge, and a self-supporting plastic liner that fits inside of the carton for containing liquids, viscous material, or particulate material. The liner has a side wall, a closed bottom end characterized by a bottom wall formed integral with the side wall, and an open top end having an outwardly-projecting rim. The rim has a radially-extending flange portion, and a dependent skirt portion, wherein when the self-supporting plastic liner is inside of the carton, the radially extending flange portion rests generally on the top edge of the carton. The packaging assembly also has a plastic lid comprising an inner portion and a rim, wherein the rim of the plastic lid is configured to fit snugly with the rim of the plastic liner, and a carton lid fitting over the carton, plastic liner, and plastic lid.

The present disclosure, in another embodiment, relates to a packaging assembly for holding liquids, viscous material, or particulate material. The packaging assembly includes a system for holding and supporting liquids, viscous material, or particulate material. The system for holding and supporting a liquid, viscous, or particulate material may include a carton that has side and bottom walls and an open top that can hold a plastic liner for containing liquids, viscous material, or particulate material. Also included is a plastic liner having side and bottom walls and an open top end with an outwardly-projecting rim. The rim has a radially-extending flange portion, and a dependent skirt portion. The plastic liner fits inside the carton. The packaging assembly also includes a securing system for the carton that contains the plastic liner that is filled with a liquid, viscous, or particulate material. The securing system includes a plastic lid that includes a covering portion and a rim. The rim of the plastic lid makes a snap fit with the rim of the plastic liner, and the plastic lid is removeably interlocking with the plastic liner. Also included in the securing system is a carton lid fitting over the carton, plastic liner, and plastic lid.

The present disclosure in yet another embodiment relates to a method for packaging and holding liquids, viscous materials, or particulate materials. One step of the method is to place a plastic liner inside of a carton. The plastic liner has side and bottom walls and an open top end with an outwardly-projecting rim. The rim has a radially-extending flange portion, and a dependent skirt portion. The carton has side and bottom walls and an open top. Another step is to fill the plastic liner with a liquid, viscous, or particulate material. A plastic lid is snap fit onto the plastic liner. The plastic lid includes a covering portion and a rim. The rim of the plastic material is removably interlocking with the plastic liner. Next the carton lid is secured over the carton. The carton lid fits over the carton, plastic liner, and plastic lid.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

DETAILED DESCRIPTION

The present disclosure relates to a novel and advantageous sustainable packaging system that may be used to ship liquid or viscous products or particulate matter. Traditionally, liquid products, for example thick viscous products such as thick paints and inks, cosmetic compounds, food glazes and fillings, drywall mud, thick roof sealants, powders and flakes, or like products have been packed for shipping or sale in pails or buckets made of materials such as steel or thick plastic. A single traditional 20 liter bucket of this type may weigh approximately 2.25 pounds empty, which adds a considerable amount of weight to a truckload of product. Buckets or pails are also typically cylindrically shaped, making them inefficient for skidding or shipping because there is a substantial amount of unused space between one bucket and the next bucket. Further, due to the rigidity of the buckets, they may take up a significant amount of space after use, but before disposal. Additionally, the buckets may be difficult or costly to dispose of or recycle.

The packaging system of the present disclosure generally includes an outer container or carton box, and an inner liner. The inner liner may be sealed after the liner is filled with product. A liner cover may be placed over the sealed liner and/or a carton box cover may be placed over the cardboard box containing the sealed and filled inner liner. The square or rectangular shape of the packaging system allows one box to be placed directly next to and/or on top of another box, effectively maximizing the amount of product that can be stored or shipped in a limited space. For shipping purposes, the more units that can be loaded per truck reduces inbound transportation costs.

In addition to the advantageous shape of the packaging system of the present disclosure, a single empty packaging system, in one embodiment, may weigh approximately 0.3 pounds, compared to the approximately 2.25 pounds for a traditional pail of similar volume. This weight difference results in a 7.5 to 1 ratio in weight savings for the packaging system of the present disclosure over the traditional pail. The lighter weight packaging system of the present disclosure may be easier to move, be less costly to ship, require less energy to produce, and be easier to recycle, and easier to store prior to recycling than traditional pails.

Figure 1:
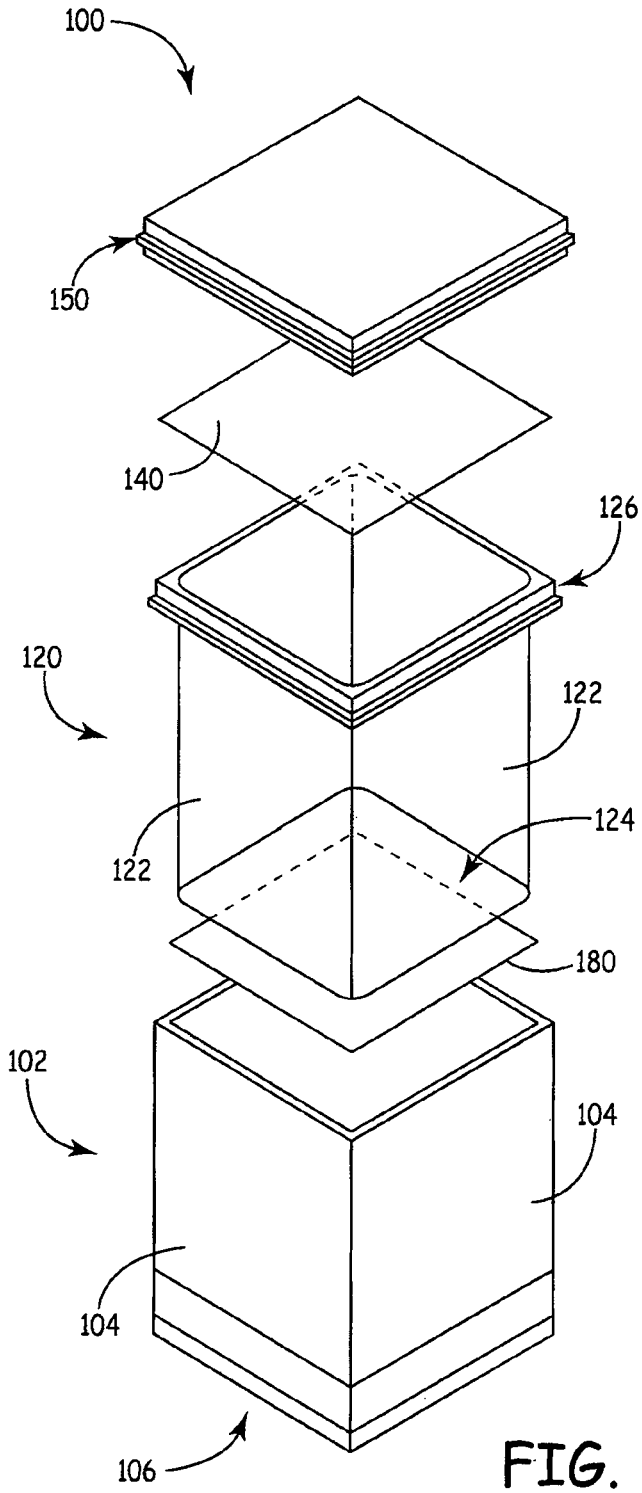
FIG. 1 is an exploded perspective view of the components of a packaging system according to one embodiment of the present disclosure.

FIG. 1 shows an embodiment of the packaging system 100 of the present disclosure. The embodiment of the packaging system 100 may include a carton 102, an optional pad or liner 180, a plastic liner 120, a lidding material 140 that may be sealed to the plastic liner 120, and a plastic lid 150. The carton 102 may be a conventional cardboard box constructed of, for instance, corrugated cardboard and a stiff paperboard that may be 100% recyclable, although, other light and/or recyclable materials may be used for the carton. The carton 102 may have a generally square or rectangular cross-sectional shape. Carton 102 may have a sidewall including four square or rectangular panels 104, a bottom wall 106, and in some embodiments, an open top without any flaps that need to be closed and/or sealed.

In one embodiment, the liner 120 may be made of plastic and be relatively semi-rigid and thin, approximately in the range of about 0.008 inches to about 0.030 inches thick. However, it is recognized that the liner thickness could vary and could be outside the range of about 0.008 inches to about 0.030 inches, and in some embodiments, may depend on the desired use or application of the liner 120. The liner 120 may be made by any means known in the art, such as, but not limited to vacuum forming, blow molding, or injection molding. The liner 120 may be made, for example, of a 100% recyclable material, such as, but not limited to high-density polyethylene (HDPE) or linear low density polyethylene (LLDPE). Unlike the plastic film bags used in the bag & box arrangement described above, the liner 120 may be self-supporting. However, the relative thinness of the liner may make the liner easily collapsible, which may significantly reduce the volume and cost of disposal as compared to traditional pails. Due to the thinness and/or the weight of the carton 102 and/or the liner 120, more, and in some cases significantly more, liners may be shipped via truck than traditional rigid buckets. For instance, the liner may be shipped in truck loads of approximately 28,000 units compared to only 3,412 traditional buckets per truck. Increasing the number of liners that may be shipped in a single truck load can advantageously result in less truck loads needed to ship the packaging system of the present disclosure and therefore less greenhouse gases being produced.

Figure 2:
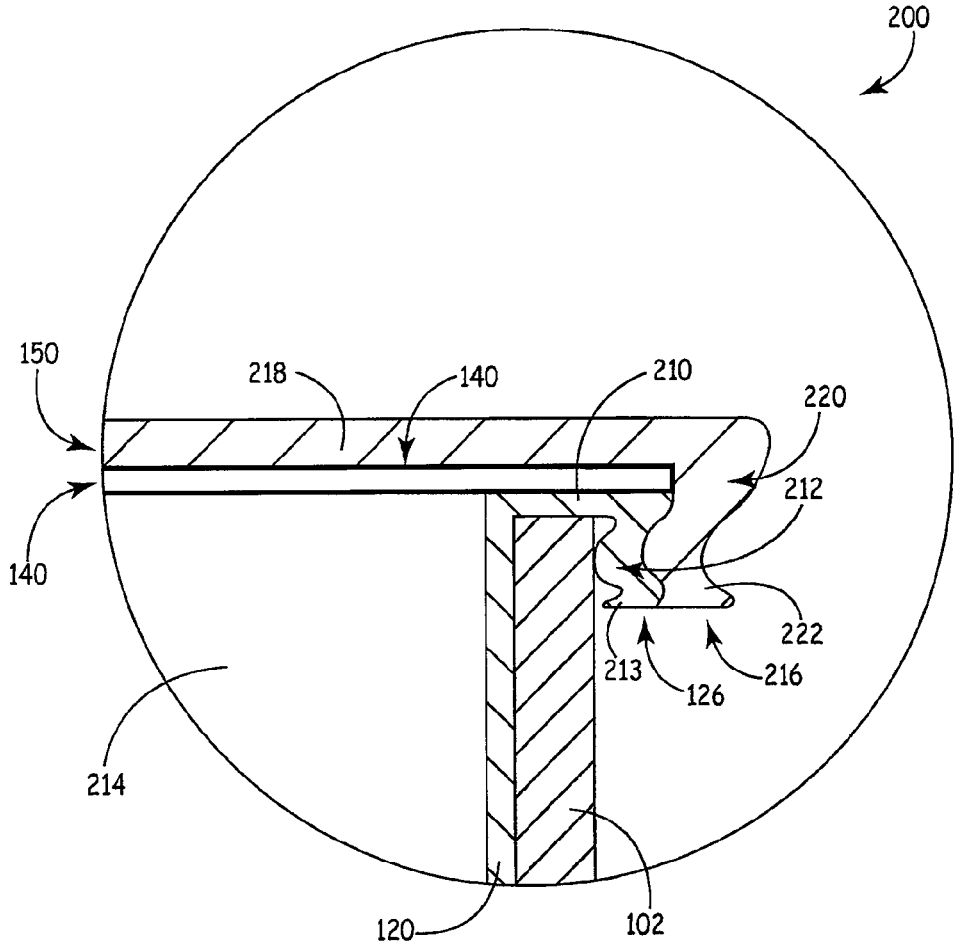
FIG. 2 is an enlarged fragmentary sectional view illustrating the components of a packaging system according to one embodiment of the present disclosure.

The liner 120 may have a cross-sectional shape similar to the carton 102. Alternately, the liner may have any other shape, such as, but not limited to a cylindrical shape. In any case, the liner 120 can be sized to fit within the carton 102. In the illustrated embodiment, the liner 120 has a substantially square cross-sectional configuration and comprises a bottom wall 124 and a side wall including four sides or panels 122 that can be substantially similar in shape to panels 104 of carton 102. When the plastic liner 120 is inside the carton 102, the plastic liner 120 may rest on and be supported by the bottom wall 106 of the carton 102. Panels 122 may typically be generally slightly smaller than panels 104 of carton so as to permit the liner 120 to fit inside the carton 102. In one embodiment, panels 122 of the plastic liner 120 may lie substantially close to the side walls 104 of the carton 102 when the liner is placed in the carton. The top end of the liner 120 can be open but may be formed with a rim 126. As can best be seen in FIG. 2, the rim 126 of the liner 120 may include a radially extending flange portion 210 and a depending skirt portion 212. The rim 126 may extend fully around the perimeter of the liner 120, being an integral extension of the upper end of the panels 122. In another embodiment, the rim may extend partly around the perimeter of the liner. When the liner 120 is placed in the carton, the top edge of the carton sidewall 104 can be positioned underneath the rim 126 of the liner 120 as can be seen in FIG. 2, with the top edge of the sidewall 104 between the sidewall of the liner 120 and the skirt portion 212.

A lidding material 140 may be sealed over the top of the liner 120 in order to contain the product within the liner 120. The lidding material 140 can be advantageous when the contents of the liner must be protected against moisture, air, bacteria, or other materials that may have a deleterious effect on the contents. The lidding material 140 may be, for example, a thin film plastic material or a thin metal foil that may be sealed to the liner 120 by any means, for example by hermetically heat-sealing the lidding material 140 to the liner 120. In other embodiments, the lidding material may be manufactured from any material suitable for sealing the liner from one or more of moisture, air, bacteria, or other materials that may have a deleterious effect on the contents. In some embodiments, the lidding material may be made of a 100% recyclable material. The lidding material may also be secured to the liner by adhesive or other methods of sealing now known or developed in the future. As can be seen in FIG. 2, the lidding material 140 may cover the entire open area 214 of the liner 120 and may be sealed to the radially extending flange 210 which runs along the perimeter of the sidewall 122 of the liner 120. In some embodiments, a packaging system may not contain a lidding material, but may contain either a plastic lid, a carton lid, or both a plastic lid and a carton lid, as will be described in detail below.

The packaging system 100 illustrated in FIG. 1 shows a plastic lid 150 that may fit over both the liner 120 and the carton 104 when the liner is placed inside the carton. FIG. 2 shows the plastic lid 150 secured over the rim 126 of the liner 120. The plastic lid 150 may be made of a resilient plastic or other suitable resilient material and be shaped to generally fit over the opening of the liner 120. By way of example but not limitation, the plastic lid may be made of the same material as the liner or some other material, and may have the same or different thickness. The plastic lid 150 may include a rim 216 that is designed to substantially interlock or otherwise removably couple with the rim 126 of the liner 120. As can best be seen in FIG. 2, the plastic lid 150 has a center portion 218 that may cover the lidding material 140 of the liner 120. In alternative embodiments, the center portion 218 or portions thereof, of the lid 150 may be eliminated. The rim 216 of the plastic lid 150 may include a skirt portion 220 that fits over, and in some cases snuggly over, the skirt portion 212 of the liner 120. The interlocking skirt portions 212, 220 of the liner 120 and plastic lid 150 may be of any configuration that permits a generally snug fit between the liner skirt portion 212 and the plastic lid skirt portion 220. In the embodiment shown in FIG. 2 the skirt portions 212, 220 are generally C-shaped, bulging outward, away from the boxing system, at the top of the skirt portion, then curving inward toward the boxing system, and then curving outward again forming a lip 213, 222 around the perimeter of both the liner and the plastic lid. However, it is recognized that any suitable interlocking or coupling mechanism or means may be used to removeably couple the lid 150 to the liner 120.

Figure 3:
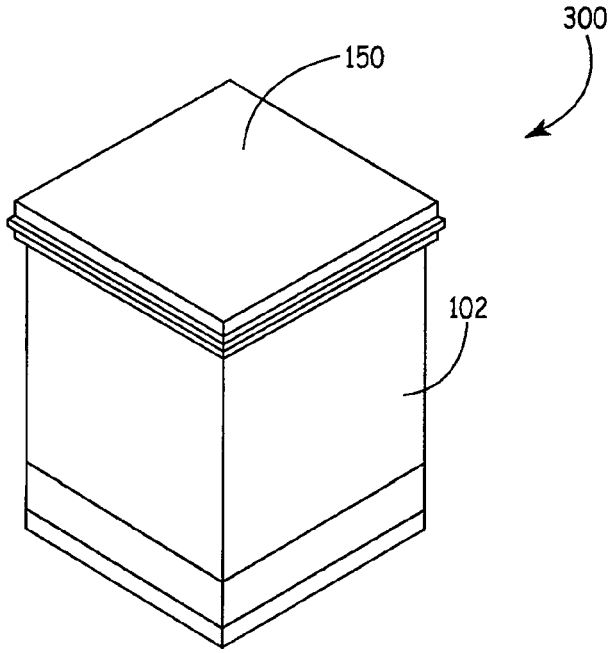
FIG. 3 is a perspective view of one embodiment of an assembled packaging system.

The plastic lid 150 may be attached to the liner 120 by pressing it down over the rim 126 of the liner 120. The pressing down action can result in the bottom end of the skirt portion 220 of the plastic lid 150 being forced outwardly far enough to snap over the skirt portion 212 of the liner 120. The inherent resilience of the plastic of which the plastic lid 150 is made can cause its rim 216 to engage, or tightly engage, with the liner rim 126 as shown in FIG. 2, thereby removeably locking the plastic lid 150 to the liner 120. The plastic lid 150 may be removed by urging it upwardly away from the liner 120, with the skirt portion 220 of the plastic lid flexing outwardly to release the plastic lid from the liner. FIG. 3 shows a carton 102 with a plastic lid 150 secured to a liner that is inside of the carton 102.

Figure 4B:
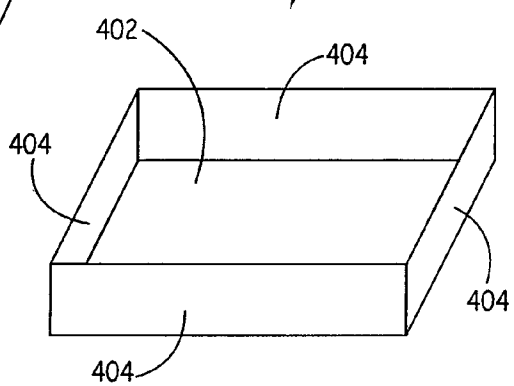
FIG. 4*b* is a perspective view of a carton lid according to one embodiment of the present disclosure.
Figure 4A:
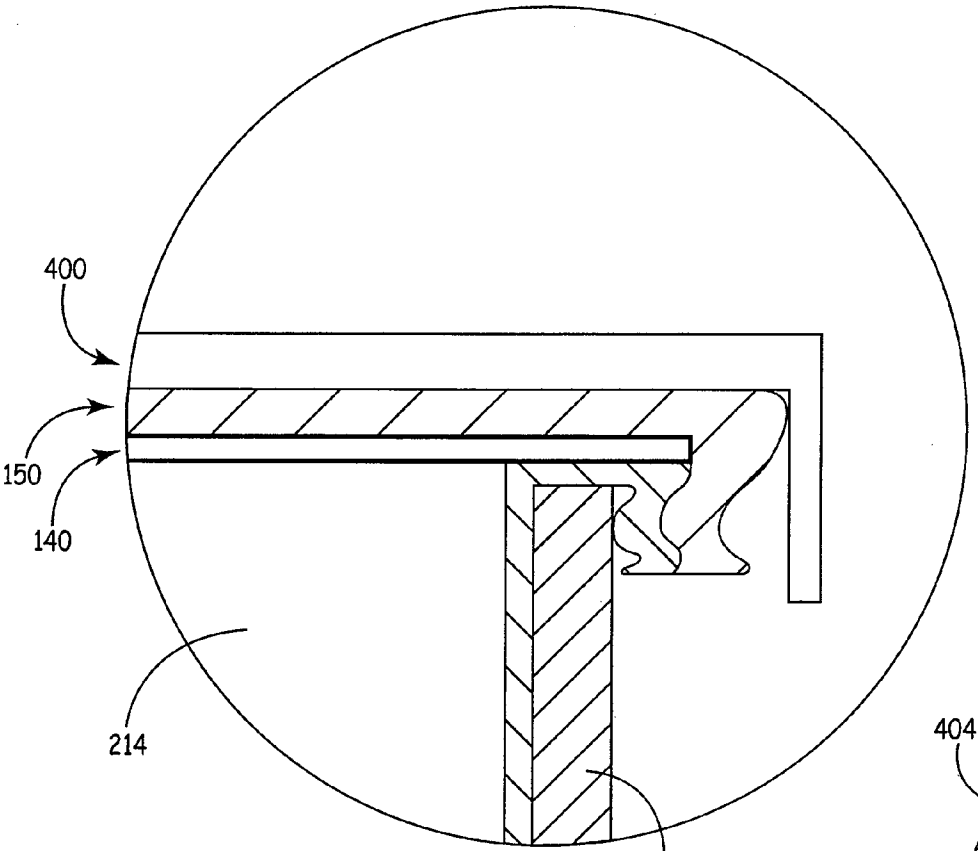
FIG. 4*a* is an enlarged fragmentary sectional view illustrating the components of a packaging system according to another embodiment of the present disclosure.

In another embodiment, the packaging system may have a carton lid in addition to or instead of a plastic lid. FIG. 4*a* shows a cross-section of an embodiment including both a plastic lid 150 and a carton lid 400. As shown in FIG. 4*b*, the carton lid 400 may be made of, for instance, corrugated cardboard and a stiff paperboard that may be 100% recyclable. By way of example, but not limitation, the carton lid 400 may be made of the same material as the carton 102 or some other material, and may have the same or different thickness. The carton lid 400 can be made to fit generally over the carton 102 and liner 120. FIG. 4*b* illustrates a carton lid 400 with an inner portion 402 and four side walls 404. The carton lid 400 can have substantially the same shaped cross-section as the carton it will cover, except that the carton lid may be slightly bigger than the carton so that the carton lid may fit over, and in some cases securely over, the carton 102 and the liner 120. Thus, like the carton itself, the carton lid may be either square-shaped or rectangular-shaped.

In another embodiment the packaging system may include a carton 102, a liner 120, a lidding material 140, and a carton lid 400 without a plastic lid 150. In yet another embodiment the packaging system may include a carton 102, a liner 120, a plastic lid 150, and a carton lid 400 without a lidding material.

Figure 5A:
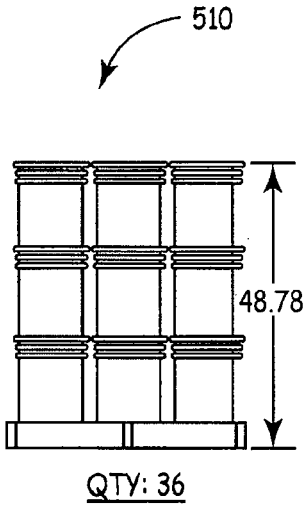
FIG. 5*a* is a perspective view of traditional packing buckets skidded on a pallet.
Figure 5B:
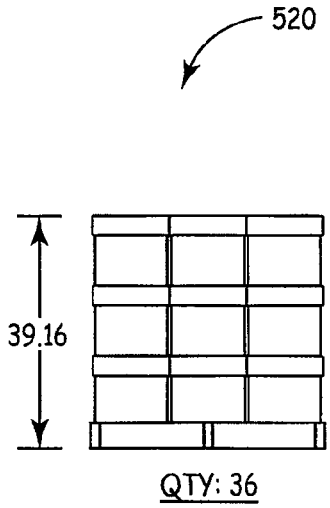
FIG. 5*b* is a perspective view of an embodiment of the present disclosure skidded on a pallet with 36 packaging assemblies.
Figure 5C:
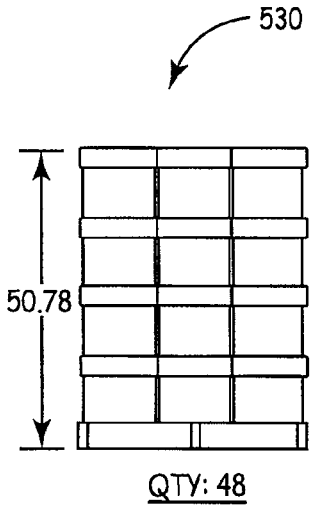
FIG. 5*c* is a perspective view of an embodiment of the present disclosure skidded on a pallet with 48 packaging assemblies.

Because traditional pails or buckets that are used to ship viscous materials are typically cylindrical, a significant amount of space may be wasted during shipping because one bucket can not line up directly next to another bucket as can be seen in FIG. 5*a*. Further, because traditional pails are so thick, each bucket takes up more space, and in some cases significantly more space, than the packaging system of the present disclosure. This can best be seen in FIGS. 5*a* and 5*b* which show how the same quantity of product would be skidded in the present disclosure 520 and in the traditional bucket system 510. As can been seen, each skid 510, 520 contains 36 units, however, the height of the skidded present disclosure 520 is considerably less than the height of the skidded traditional bucket 510. In fact, adding another layer of the packaging system of the present disclosure to the skid 520 may only increase the height of the skid by a small amount, such as a couple inches, compared to the traditional bucket system 510 as shown in FIGS. 5*a* and 5*c*. Adding this additional layer can result in more product per skid, and in some cases up to 33% or more product. In addition to being able to store and/or ship more, and in some cases significantly more, product by means of the present disclosure, the same quantity of product weighs less, and in some cases significantly less, when packaged using the present disclosure rather than the traditional buckets. This may make product packaged using the present disclosure easier to move, and in some cases less costly to ship.

In practice, the liner of the present disclosure may be filled with a liquid, viscous material or particulate material before the liner is placed in the carton, or while the liner is in the carton. In existing conventional packaging systems, a liner might also be filled before being placed inside a box, or after being placed in a box. However, if a sealing member was going to be applied to the liner, the liner would have to be filled before being placed in the box. In that case, a sleeve or support member would need to be placed around the liner to stabilize the liner. Alternately, in conventional packaging systems, the liner could be placed inside the box and then filled with material, but in that case, the liner could not be sealed with a lidding material. One such existing packaging system is described in U.S. Pat. No. 6,892,933, the entirety of which is hereby incorporated by reference herein. One novel and advantageous aspect of some embodiments of the present disclosure, however, is that the liner may be filled when it is in the carton, and the lidding material may be sealed to the liner after the liner has been filled, and while the liner is still in the carton.

Figure 6:
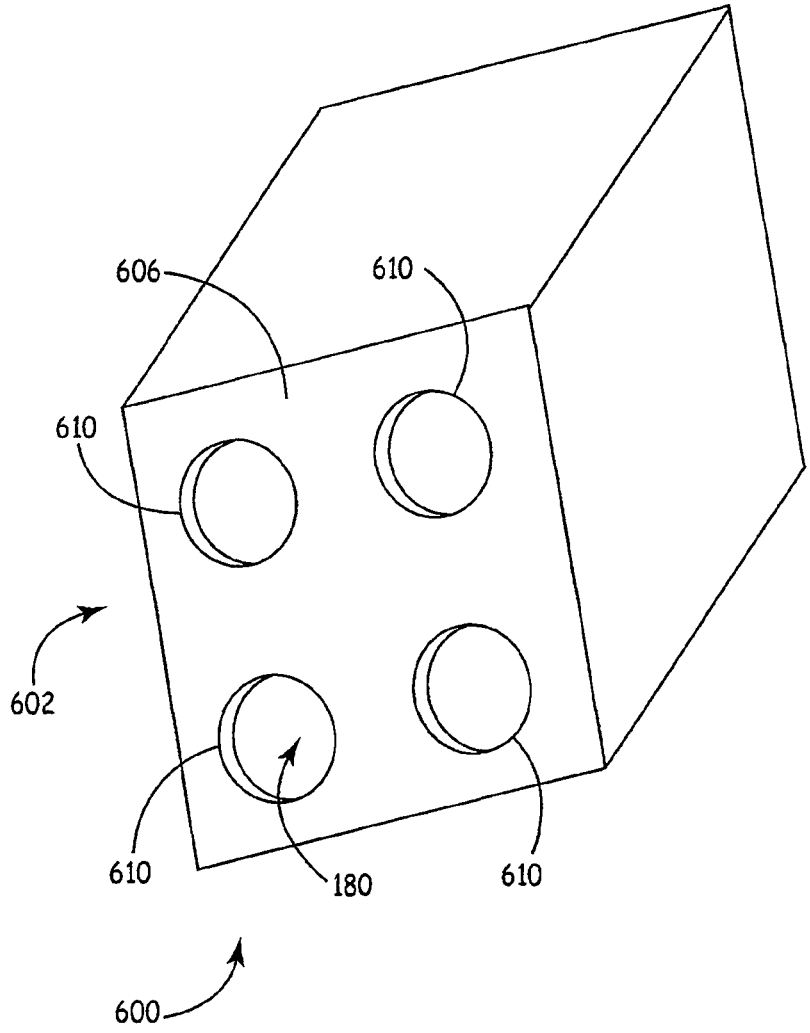
FIG. 6 is a perspective view of the bottom wall of a carton with four round liner access points, according to one embodiment of the present disclosure.

A further embodiment of the present disclosure illustrated in FIG. 6 shows the bottom wall 606 of a carton 602. In this embodiment, the bottom wall 606 may contain liner access points 610. While four liner access points 610 are shown, it is recognized that fewer or greater liner access points 610 may be used as suitable or desirable for the intended application. In the embodiment shown, the liner access points 610 are round, but they may be any shape, such as but not limited to square, rectangular, triangular, oblong, etc. The liner access points 610 are areas that are cut out or otherwise removed from the bottom wall 602 creating openings in the bottom wall 602, such that when the liner 120 is inside the carton 602, the liner may be accessed and pushed up from the bottom of the carton 602. During the packing process, the liner 120 may be placed in the carton 602 in order to fill the liner 120 with material. Prior to sealing the lidding material 140 on the liner 120, the liner 120 may be pushed up, for example, approximately ½ inch to 1½ inches, or any other suitable amount, in order to seal the lidding material 140 on the liner 120. The liner 120 may be raised for sealing by pushing up on the liner 120 through the liner access points 610 in the bottom wall 606 of the carton 602.

In some embodiments, a liner pad 180, as shown in FIGS. 1 and 6, may be removeably placed inside of the carton 602 prior to placing the liner in the carton. The pad 180 may rest between the bottom wall 606 of the carton 602 and the bottom of the liner. When the liner is pushed up for sealing through the liner access points 610, the pad 180 may equalize the pressure applied to the liner and help stabilize the liner, allowing the filled liner to keep its shape as it is pushed upward. The pad 180 may be made of corrugated cardboard. In other embodiments, the pad may be made of another paper material, plastic, wood, metal, or any other suitable material, or combination of materials. In one embodiment, the pad 180 may be of any desirable thickness. For instance, a relatively thin pad may be used with liners that are not intended to be very heavy when filled, whereas a thicker pad may be desirable when the filled liner is expected to be heavy. In other embodiments, a pad may not be used at all. In some embodiments, the pad 180 may be square or rectangular in shape and sized to fit snuggly within the perimeter of the square or rectangular panels 104 of the sidewall of the carton 602. In alternative embodiments, the pad 180 may be shaped other than as a square or rectangular, such as but not limited to circular, triangular, ovoid, etc. Similarly, the pad 180 need not be sized to fit snuggly within the perimeter of the square or rectangular panels 104 of the sidewall of the carton 602, and in some embodiments the pad 180 may be sized such that the pad 180 covers at least a portion of one or more of the liner access points 610.

Once the filled liner has been covered with a lidding material, a plastic lid may be applied to the liner. Additionally, a carton lid may cover the plastic lid. In other embodiments, as mentioned previously, only a carton lid may cover the lidding material of the liner. The packaging system may then be shrink wrapped or banded for skidding and shipping.

Figure 7:
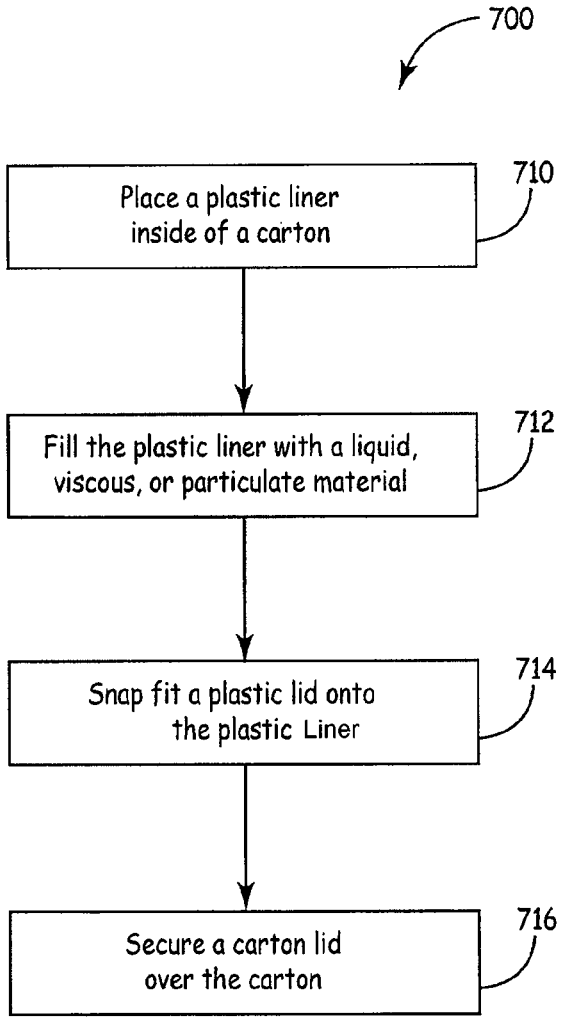
FIG. 7 is a flow diagram illustrating a method for packaging and holding liquid, viscous, and particulate materials, according to one embodiment of the present disclosure.

A further embodiment of the present disclosure is a method for packaging and holding liquids, viscous, or particulate materials as illustrated in FIG. 7. In one embodiment, a plastic liner may be placed inside of a carton 710. Once the liner is inside of the carton, the liner may be filled with a liquid, viscous, or particulate material, or any combination thereof 712. After the liner has been filled, in some embodiments, a plastic lid may be snap fit onto the plastic liner to secure the contents of the liner within 714. In some embodiments a carton lid may be secured over the plastic lid, 716.

In another embodiment of the present disclosure, a lidding material is affixed to the plastic liner after the plastic liner has been filled with product. In some embodiments, the affixing of the lidding material may be facilitated by pushing the plastic liner up and away from the carton so as to more easily access and seal the lidding material onto the rim of the plastic liner. The plastic liner may be pushed up through liner access points in the bottom of the carton, as described above.

Another advantage of the present disclosure is that the system may be integrated into already existing single and multi-head filling lines. Furthermore, the carton 102 may be assembled using standard equipment. The liner 120 may be installed, and the carton 102 and liner 120 may be conveyed to the existing filler. Once the liner 120 has been filled with product, a lidding material 140 may be heat sealed in place to protect the product. A plastic lid 150 may, or may not be, installed over the liner 120. A secondary or tertiary carton lid 400 may, or may not be, installed over the packaging system to protect the package during shipping. Then the packaging system may be shrink wrapped or banded for skidding and shipping.

In the foregoing description various embodiments of the present disclosure have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

We claim:

1. A packaging assembly for holding liquids, viscous material, or particulate material comprising:

a carton having side and bottom walls and an open top forming a top edge, the carton defining exterior sides of the packaging assembly;

a self-supporting plastic liner that fits inside of the carton, and is for containing liquids, viscous material, or particulate material, said liner comprising a side wall, a closed bottom end characterized by a bottom wall formed integral with said side wall, and an open top end having an outwardly-projecting rim, said rim comprising a radially-extending flange portion, and a dependent skirt portion at least partially extending over said exterior sides of the packaging assembly, wherein when the self-supporting plastic liner is inside of the carton, the radially extending flange portion rests generally on the top edge of the carton;

a plastic lid comprising an inner portion and a rim, wherein the rim of the plastic lid is configured to fit snugly with the rim of the plastic liner and is removeably interlocking with the plastic liner; and a carton lid fitting over the carton, plastic liner, and plastic lid.

2. A packaging assembly according to claim 1, further comprising a lidding material, wherein the lidding material is removeably affixed to the rim of the plastic liner once the plastic liner has been filled with liquid, viscous material, or particulate material.

3. A packaging assembly according to claim 2, wherein the bottom wall of the carton contains at least one plastic liner access point, whereby when a plastic liner is inside of the carton and resting on the bottom wall, the plastic liner may be pushed upward by contacting the liner through at least one plastic liner access point.

4. A packaging assembly according to claim 2, further comprising a pad that is placed inside of the carton and that rests against the bottom wall of the carton, and wherein the bottom wall of the carton contains at least one plastic liner access point, whereby when a plastic liner is inside of the carton and resting on the pad, the pad and the plastic liner may be pushed upward by contacting the pad through at least one plastic liner access point.

5. A packaging assembly according to claim 2, wherein the carton, the plastic liner, the lidding material, and the carton lid are all made of recyclable material.

6. A packaging assembly according to claim 2, wherein the lidding material is detachably affixed to the radially-extending flange of the plastic liner.

7. A packaging assembly according to claim 6, wherein the lidding material is affixable to the radially-extending flange of the plastic liner while the plastic liner is inside the carton.

8. A packaging assembly according to claim 1, wherein the plastic liner and plastic lid are made of recyclable high-density polyethylene.

9. A packaging assembly according to claim 1, wherein the plastic liner and plastic lid are made of recyclable linear low-density polyethylene.

10. A packaging assembly according to claim 1, wherein the rim of the plastic lid and the rim of the plastic liner are substantially C-shaped.

11. A packaging assembly according to claim 1, wherein the rim of the plastic lid makes a snap fit with the rim of the plastic liner.

12. A packaging assembly according to claim 1, wherein the plastic liner rests on and is supported by a bottom wall of the carton.

13. A packaging assembly according to claim 1, wherein the carton and the carton lid are substantially square shaped in cross-section, and wherein the plastic liner lies substantially close to the side wall of said carton.

14. A packaging assembly according to claim 1, wherein the carton and the carton lid are substantially rectangular in cross-section, and wherein the plastic liner lies substantially close to the side wall of the carton.

15. A packaging assembly for holding liquids, viscous material, or particulate material comprising:

a system for holding and supporting a liquid, viscous, or particulate material comprising:

a carton having side and bottom walls and an open top that can hold a plastic liner for containing liquids, viscous material, or particulate material, the carton defining exterior sides of the packaging assembly; and a plastic liner having side and bottom walls and an open top end with an outwardly-projecting rim, said rim comprising a radially-extending flange portion, and a dependent skirt portion at least partially extending over said exterior sides of the packaging assembly, wherein the plastic liner fits inside the carton; and a securing system for the carton containing the plastic liner filled with a liquid, viscous, or particulate material, comprising:

a plastic lid including a covering portion and a rim, wherein the rim of the plastic lid makes a snap fit with the rim of the plastic liner, and wherein the plastic lid is removeably interlocking with the plastic liner; and a carton lid fitting over the carton, plastic liner, and plastic lid.

16. The packaging system of claim 15, wherein the bottom wall of the carton contains at least one plastic liner access point, whereby when a plastic liner that rests on the bottom wall is inside of the carton, the plastic liner may be contacted through the at least one plastic liner access point and pushed upwards.

17. The packaging system according to claim 16, further comprising a lidding material, wherein the lidding material is removeably affixed to the rim of the plastic liner once the plastic liner has been filled with a liquid, viscous material, or particulate material, and wherein the lidding material is affixable to the rim of the plastic liner when the plastic liner is inside of the carton, and wherein the plastic liner is pushed up via the at least one plastic liner access point to facilitate affixing the lidding material to the plastic liner.

18. The packaging system of claim 15, further comprising a pad that is placed inside of the carton and that rests on the bottom wall of the carton, wherein the bottom wall of the carton contains at least one plastic liner access point, whereby when a plastic liner that rests on the pad is inside of the carton, the plastic liner and pad may be contacted through the at least one plastic liner access point and pushed upwards.

19. A method for packaging and holding liquids, viscous materials, or particulate materials, comprising:

placing a plastic liner inside of a carton, the plastic liner comprising side and bottom walls and an open top end with an outwardly-projecting rim, the rim comprising a radially-extending flange portion and a dependent skirt portion, wherein the carton comprises side and bottom walls and an open top, and wherein when the plastic liner is inside of the carton, the dependent skirt portion of the rim of the plastic liner generally hangs over the side walls of the carton;

filling the plastic liner with a liquid, viscous, or particulate material;

snap fitting a plastic lid onto the plastic liner, wherein the plastic lid comprises a covering portion and a rim, wherein the rim of the plastic material is removably interlocking with the plastic liner; and securing a carton lid fitting over the carton, plastic liner, and plastic lid.

20. The method of claim 19, wherein the carton contains at least one plastic liner access point, whereby when a plastic liner is inside of the carton, the plastic liner may be contacted through said at least one plastic liner access point and pushed upwards.

21. The method of claim 20, further comprising sealing the plastic liner filled with a liquid, viscous, or particulate material with a lidding material prior to snap fitting the plastic lid onto the plastic liner, wherein the lidding material is removably affixed to the rim of the plastic liner.

22. The method of claim 21, wherein the plastic liner is pushed upwards via the at least one plastic liner access point to facilitate affixing the lidding material to the plastic liner.

23. The method of claim 19, further comprising a pad that is placed inside of the carton and that rests on the bottom wall of the carton, wherein the carton contains at least one plastic liner access point, whereby when a plastic liner is inside of the carton, the pad may be contacted through said at least one plastic liner access point and pushed upwards together with the plastic liner.

* * * * *